US010540834B2

(12) United States Patent
Trani

(10) Patent No.: US 10,540,834 B2
(45) Date of Patent: Jan. 21, 2020

(54) FRICTIONLESS ACCESS CONTROL SYSTEM WITH USER TRACKING AND OMNI AND DUAL PROBE DIRECTIONAL ANTENNAS

(71) Applicant: Sensormatic Electronics, LLC, Boca Raton, FL (US)

(72) Inventor: James Trani, Albuquerque, NM (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 15/729,926

(22) Filed: Oct. 11, 2017

(65) Prior Publication Data

US 2018/0102007 A1 Apr. 12, 2018

Related U.S. Application Data

(60) Provisional application No. 62/406,725, filed on Oct. 11, 2016.

(51) Int. Cl.
*G07C 9/00* (2006.01)

(52) U.S. Cl.
CPC ..... *G07C 9/00111* (2013.01)

(58) Field of Classification Search
CPC ..... G07C 9/00111
See application file for complete search history.

(56) References Cited

U.S. PATENT DOCUMENTS 4,574,289 A * 3/1986 Henderson ..... H01Q 13/0208 333/257
4,634,963 A * 1/1987 Lunden ..... G01R 31/2805 324/632
5,629,981 A * 5/1997 Nerlikar ..... G06K 7/0008 340/10.31
6,275,196 B1 * 8/2001 Bobier ..... H01Q 19/138 343/772
6,735,630 B1 * 5/2004 Gelvin ..... B60R 25/1004 706/33
7,023,356 B2 * 4/2006 Burkhardt ..... G06K 7/0008 340/8.1
7,367,497 B1 * 5/2008 Hill ..... G07C 9/00111 235/380
9,689,958 B1 * 6/2017 Wild ..... G01S 3/8003

(Continued)

*Primary Examiner* — Joseph H Feild
*Assistant Examiner* — Rufus C Point
(74) *Attorney, Agent, or Firm* — HoustonHogle LLP

(57) ABSTRACT

An access control system includes a mesh network of nodes for tracking and authenticating users throughout a building. The nodes include wireless interfaces. The user devices send user information to the nodes, which send the user information to a verification and tracking system, which returns authentication status information. As the user moves throughout the building, the nodes calculate the proximity between the particular node and the user device and compare the calculated proximity information to that of nearby nodes. The user information and authentication status information is then handed off to the node determined to be closest to the user device and, in the case of door nodes connected to door controllers, is used to grant access to restricted areas of the building. Door nodes are equipped with directional antennas with an adjustable antenna assembly including two or more probes to eliminate dead zones around the door nodes.

21 Claims, 16 Drawing Sheets

(56) References Cited

U.S. PATENT DOCUMENTS

2001/0036814 A1* 11/2001 Bobier ..... H01Q 1/246 455/103
2003/0101253 A1* 5/2003 Saito ..... H04L 45/02 709/223
2003/0128100 A1* 7/2003 Burkhardt ..... G06K 7/0008 340/5.8
2005/0225444 A1* 10/2005 Clift ..... G06K 17/00 340/539.13
2009/0248548 A1* 10/2009 Obermeyer ..... G06Q 10/087 705/28
2010/0281051 A1* 11/2010 Sheffi ..... H04L 67/2819 707/770
2011/0187493 A1* 8/2011 Elfstrom ..... G06Q 10/02 340/5.6
2012/0154115 A1* 6/2012 Herrala ..... G07C 9/00111 340/5.64
2013/0176107 A1* 7/2013 Dumas ..... G07C 9/00571 340/5.61
2014/0230030 A1* 8/2014 Abhyanker ..... H04L 63/107 726/6
2015/0023204 A1* 1/2015 Wik ..... H04W 48/14 370/254
2015/0154844 A1* 6/2015 Skaaksrud ..... H04W 12/06 340/539.13
2015/0245167 A1* 8/2015 Bobrow ..... H04W 4/023 455/41.2
2015/0351007 A1* 12/2015 Bell ..... H04W 48/14 370/315
2016/0055693 A1* 2/2016 Somani ..... G07B 15/02 340/5.61
2016/0063783 A1* 3/2016 Bruns ..... G07C 9/00111 340/5.61
2016/0104334 A1* 4/2016 Handville ..... G07C 9/00571 340/5.61
2016/0284147 A1* 9/2016 Trani ..... G01S 5/00
2016/0374045 A1* 12/2016 Pandharipande ..... G01S 1/68
2017/0069149 A1* 3/2017 Scheja ..... G07C 9/00023
2017/0104271 A1* 4/2017 Perottino ..... H01Q 13/0208
2017/0264383 A1* 9/2017 Reddy ..... H04W 4/029
2018/0219869 A1* 8/2018 Kumar ..... H04W 12/12
2018/0308302 A1* 10/2018 Al-Yousef ..... G07C 9/00039

* cited by examiner

402

FRICTIONLESS ACCESS CONTROL SYSTEM WITH USER TRACKING AND OMNI AND DUAL PROBE DIRECTIONAL ANTENNAS

RELATED APPLICATIONS

This application claims the benefit under 35 USC 119(e) of U.S. Provisional Application No. 62/406,725, filed on Oct. 11, 2016, which is incorporated herein by reference in its entirety.

BACKGROUND OF THE INVENTION

Security systems are often installed within and around buildings such as commercial, residential, or governmental buildings. Examples of these buildings include offices, hospitals, warehouses, schools or universities, shopping malls, government offices, and casinos. The security systems typically include components such as system controllers, access control readers, video surveillance cameras, network video recorders (NVRs), and door controllers, to list a few examples.

The access control readers are often installed at access points of the buildings to control access to restricted areas, such as buildings or areas of the buildings. Examples of access points include front and interior doors of a building, elevators, hallways connecting two areas of a building, to list a few examples. The access control readers authenticate identities of (or authorize) individuals and then permit those authenticated individuals to access the restricted areas through the access points. Typically, individuals interact with the access control readers by swiping keycards or bringing contactless smart cards within range (approximately 2-3 inches or 5 centimeters) of a reader. The access control readers read the information of the keycards and then the access control systems determine if the individuals are authorized to access the restricted areas. If the individuals are authorized to enter the restricted areas, then the access control readers allow access to the restricted areas by unlocking locked doors, signaling that doors should be unlocked, activating elevators, or generating alarms upon unauthorized entry, for example.

More recently, frictionless access control and tracking systems have been proposed. These systems use wireless technology that enables a more transparent method for identifying and tracking individuals while providing similar access control as traditional systems and methods. The systems can automatically identify individuals as they approach or stand in threshold areas of the access points. Threshold areas are typically areas within close proximity to the access points, such as entrances of the restricted areas and/or areas in front of doors, in examples. These systems accomplish these tasks without requiring the individuals to swipe or wave keycards, for example, at card readers, and can more continuously track those users in and around buildings.

In these systems, users carry active wireless devices on their person. These user devices transmit user information, such as credentials, that identify the users to a wireless receiving device, or positioning unit. In some cases, the user devices are mobile computing devices such as smart phones or tablet computing devices. In other cases, dedicated fobs are used.

In one implementation, the positioning units are installed above access points. The positioning units include directional antennas for detecting if a user with a user device is in close proximity to the access point. The positioning units might also include an omni directional antenna for communicating with user devices in the broader vicinity to the access point. When user information is received by the positioning units, the positioning units can then determine locations of the user devices (and thus the locations of the users) comparing the strength of the signals received by the directional antenna against the signal strength received by the omni directional antenna.

SUMMARY OF THE INVENTION

One limitation to the frictionless access control systems is the reliability of positioning units, particularly of information from the directional antennas. Problems often arise due to the need to align the gain of the directional antenna relative to the threshold area of the access point. Variability in how the positioning units are manufactured and the environment surrounding the threshold (for example metal doors or large metal structures close to the positioning unit) affect how the antennas behave and the signals propagate, resulting in problems such as dead zones.

Additionally, it would be helpful for access control systems to track users as they move throughout a building, not just intermittently when they happen to approach access points.

In general, according to one aspect, the invention features an access control and user tracking system for a security system. The access control and user tracking system includes a verification and tracking system for receiving user information and generating authentication status information. Each node comprises controllers and wireless interfaces, for receiving user information and device information from user devices and sending and receiving device information and authentication status information to and from other nodes.

In embodiments, the wireless interfaces include directional antennas, and the directional antennas include adjustable assemblies, each comprising two or more elements for detecting electromagnetic waves. The wireless interfaces also include omnidirectional antennas, Bluetooth transceivers and WiFi transceivers. The nodes determine a proximity of the user devices to the nodes and send the calculated proximity information to other nodes and compare the calculated proximity information to calculated proximity information received from other nodes. Door controllers also receive authentication status information from the nodes and grant or deny access to doors based on the authentication status information. The user devices include smart phones and/or fobs.

In general, according to another aspect, the invention features a method for providing access control and tracking users of a security system. Nodes with wireless interfaces receive user information and device information from user devices and send the user information to a verification and tracking system. The verification and tracking system receives the user information, generates authentication status information, and sends the authentication status information to the nodes. The nodes send the user information, device information and authentication status information to other nodes.

According to another aspect, the invention concerns a directional antenna for an access control system, including an adjustable assembly comprising two or more elements for detecting electromagnetic waves.

A rotation stage, for adjusting the positions of the two or more elements, can also be included.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
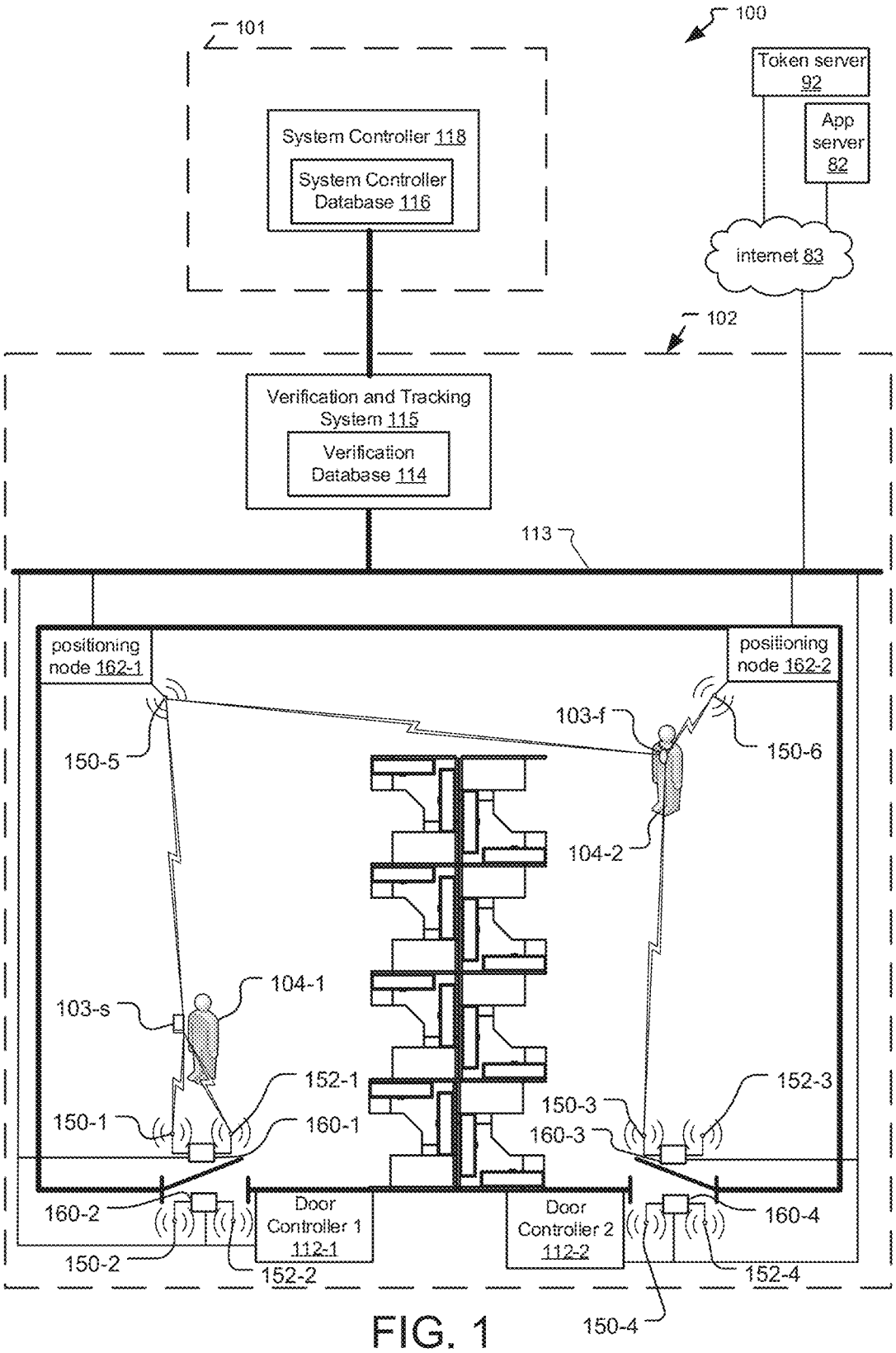
FIG. 1 is a schematic diagram of an exemplary access control system to which the current invention is directed.

FIG. 1 is a schematic diagram of an exemplary access control and tracking system 100, which has been constructed according to the principles of the present invention.

In operation, the access control and tracking system 100 identifies users 104, determines the locations of users' devices 103 such as smart phones 103-*s* or ancillary mobile computing devices 103-*f* such as fobs, enables access through access points to possibly restricted areas of a premises such as a building 102, and tracks the user devices 103 within and throughout the building 102.

In general, the system 100 also includes a verification and tracking system 115, a mesh network of door nodes 160 and positioning nodes 162, and may further include additional components such as a fingerprint reader kiosk, display devices, and door controllers 112. These components primarily communicate with one another over an enterprise data network 113, which may include wired and/or wireless portions. For example, the door nodes 160 and positioning nodes 162 communicate wirelessly via wireless local area network utilizing WiFi protocols, for example.

In more detail, in the illustrated example, door nodes 160 are located near access points, such as doors, of the building 102 or areas within the buildings such as door access points that enable users 104 to physically enter or exit the building 102 or access different parts of the building.

Additionally, according to the present invention, the door nodes 160 in combination with the positioning nodes 162 form a self-organized mesh network for tracking users 104 throughout the building 102.

In a typical implementation, the users 104 carry their user devices 103, which broadcast packet data. The packet data includes device information for identifying the user device. In one example, the device information for each user device might be a media access control (MAC) address and/or internet protocol (IP) address that has been assigned to the user device or a communication port of the user device. The packet data also typically includes user information for identifying the users. The user information can include a unique user ID for each of the user and/or other information for identifying the user such as a username/password, name of user, department, work extension, personal phone numbers, email addresses, and employee ID number, in examples. In one example, the user information includes a token or a hash of the token generated for the user 104, and the token may or may not expire after a predetermined time.

Users carrying the user devices 103 enroll and/or register the user devices 103 with the system controller 118. When the user device is a smart phone or other mobile computing device, 103-*s*, the users 104 download a security app, in one example, from the app server 82 to their user device 103-*s*, where the security app provides access to the system controller 118.

When enrolling a smart phone user device 103-*s* with a token as the user information, the smart phone user devices 103-*s* and the system controller 118 might first access a token server 92 to request the token. In response, the token server 92 generates a token, and sends the token or a hash of the token to both the system controller 118 and the user device 103 in response. The token is then included as the user ID within the user information for the user, for both the user information maintained for the user in the system controller 118 and the user information included within the user device 103.

The wireless packet data broadcast from the user devices 103 is preferably secured to prevent unauthorized third parties from intercepting and decoding the packet data during transmission (i.e. during broadcasts). In one example, the packet data is encrypted. In a preferred embodiment, the user devices 103 broadcast the packet data using BLE (Bluetooth low energy) technology.

Bluetooth is a wireless technology that operates in a 2.4 GHz (gigahertz) short-range radio frequency band. In free space, Bluetooth applications typically locate a Bluetooth device by calculating the distance of the user devices 103 from the signal receivers. The distance of the device from the receiver is closely related to the strength of the signal received from the device. A lower power version of standard Bluetooth called Bluetooth Low Energy (BLE), in contrast, consumes between ½ and 1/100 the power of classic Bluetooth. BLE is optimized for devices requiring maximum battery life, as compared to the emphasis upon higher data transfer rates associated with classic Bluetooth. BLE has a typical broadcast range of about 100-150 feet (approximately 35-46 meters).

When transmitting via BLE, the user devices 103 might send an AltBeacon compliant BLE broadcast message every second. If the user devices 103 utilize tokens as the user ID, the user devices 103 preferably include a hash representation of the token/user ID in the BLE broadcast messages. In one implementation, the hash representation of the token is a 16-byte, one-way hash of the token, computed using the phone number of the user device 103-*s* as the seed key and possibly the current time.

In an alternative implementation, the user devices 103 are capable of broadcasting via standard Bluetooth. In still other alternative implementations, the user devices 103 may broadcast via other wireless technologies such as Wi-Fi (IEEE 802.11), active RFID (radio frequency identification), or ZigBee, to list a few examples.

Each of the door nodes 160 preferably include an omni directional antenna 150 and a directional antenna 152. On the other hand, the positioning nodes 162 include a single omni directional antenna 150 in one embodiment or possibly multiple sector antennas that cover different radially extending sectors. The packet data are received by antennas 150, 152 of one or more nodes 160, 162. The nodes 160, 162 determine range and/or direction of the users 104 using one or more positioning techniques. A preferred positioning technique calculates the approximate range of the user device 103 from the door node 160 and/or positioning node 162 based on the RSSI of the signal from the user device 103.

The door nodes 160 facilitate access control by receiving the user information for each user and sending the user information and the calculated location data to the verification and tracking system 115 via data network 113. When the user devices 103 utilize tokens, the door nodes 160 might validate the tokens by comparing their own hash representations of the tokens to the representations included in the packet data. The door nodes 160 use the phone number of the user devices 103 or other reference as the seed key for this purpose in some examples. The location data are used by the verification and tracking system 115 to determine motion vectors for and to predict motion intent of the users 104, in examples.

Typically, the data network 113 is an enterprise network such as a Local Area Network (LAN), e.g., wired and/or wireless Ethernet. The door nodes 160 can also communicate with the verification and tracking system 115 via serial connections, in another example.

The verification and tracking system 115 accesses authorization information in a verification database 114, which it maintains or which it only accesses, to determine which users 104 are authorized to access specified restricted areas of a building 102 and/or pass through an access point. Once the users 104 are authenticated by the verification and tracking system 115 and it is determined that those users are authorized to transit the access point, the verification and tracking system 115 sends a door control signal via the network 113 to the door controller 112, in one example. The door controller 112 then enables access to a restricted area by unlocking an access point of the restricted area, such as a door or other portal, thereby providing access for the authorized user 104 to the restricted area while also possibly generating an alarm for an unauthorized user. The door controller 112 preferably unlocks the door when the authorized user 104 is within a threshold area near the access point (e.g., the door or other portal) of the restricted area.

In a typical implementation, the system 100 includes the system controller 118, which includes a system controller database 116. In general, the system controller 118 might store user information for each of the users 104 to the system controller database 116. The system controller database 116 also stores the authorization information 46 for the users 104 (e.g., which users 104 are permitted to access which restricted areas). Periodically, the system controller 118 sends updated user information and authorization information to the verification and tracking system 115 via the network 113. In response, the verification and tracking system 115 saves the received user information and authorization information to its verification database 114.

The verification and tracking system 115 accesses the user information and authorization information within its verification database 114, which acts as a local copy or "cache" of the information. To manage the temporal relevance of the entries in its verification database 114, the verification and tracking system 115 maintains a current time, and applies a time stamp to each item of user information and authorization information received from the system controller 118.

The mesh network of door nodes 160 and positioning nodes 162 tracks users 104 by determining which node 160, 162 is closest to the user 104 and handing off user information and authentication status information from one node 160, 162 to the next as the user 104 moves throughout the building 102.

In the illustrated example, positioning nodes 162 are installed in two corners of a room and two door nodes 160 are installed on either side of each door. One user 104-1 carries a smart phone 103-*s* that broadcasts user information that is received by both the directional antenna 152-1 and the omni directional antenna 150-1 of the first door node 160-1, as well as the omni directional antenna 150-5 of the first positioning node 162-1. The second user 104-2 carries a fob 103-*f* that broadcasts user information that is received by the first and second positioning nodes 162-1, 162-2 as well as the omni directional antenna 150-3 of the third door node 160-3.

Figure 2:
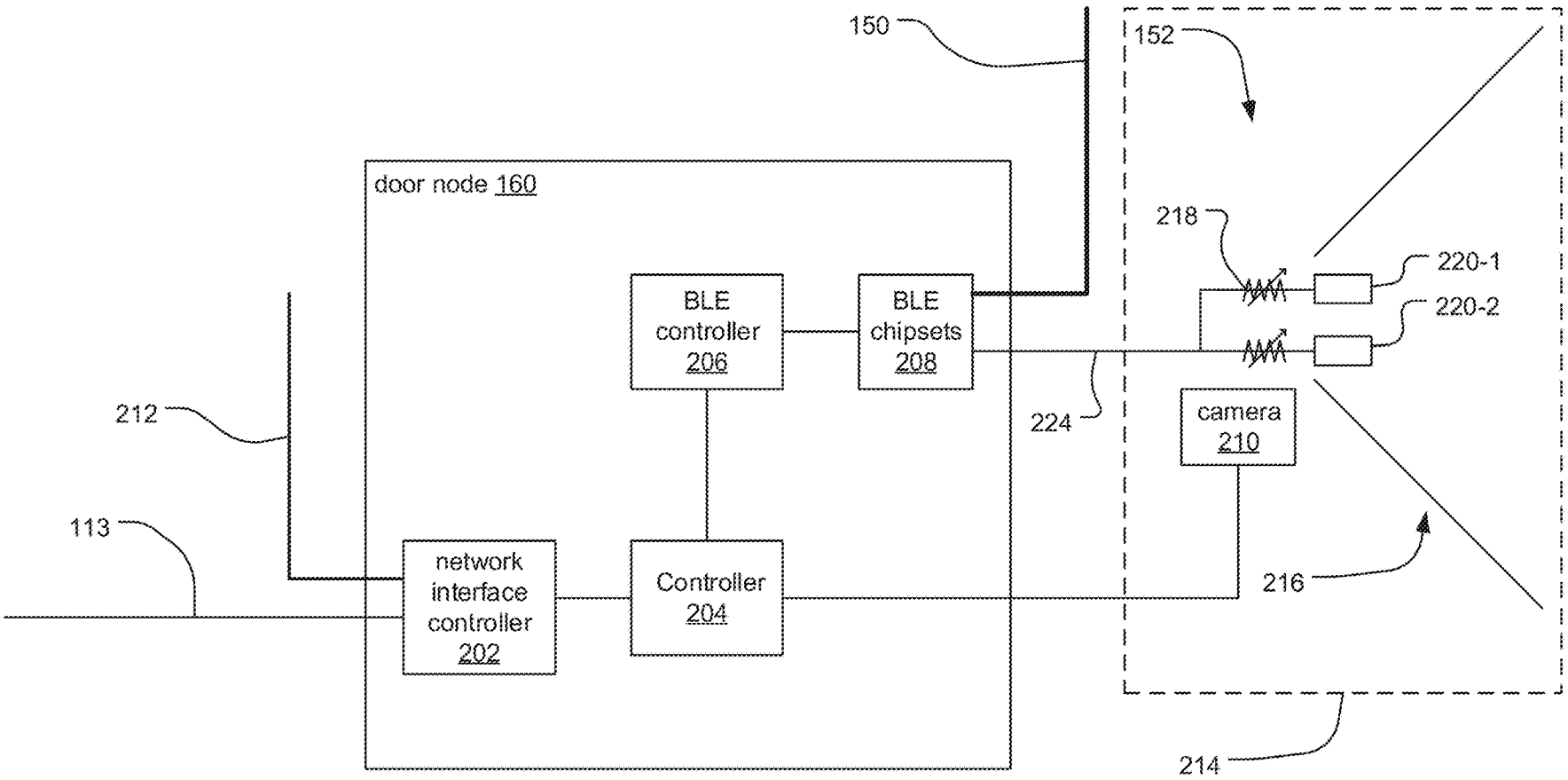
FIG. 2 is a schematic diagram illustrating one embodiment of the door node.

FIG. 2 is a schematic diagram illustrating one embodiment of the door node 160, which includes one omnidirectional antenna 150 and one directional antenna 152 (within a directional antenna assembly 214), for communicating with and determining a location of a user device 103. The directional antenna 152 includes a horn 216 for directing radio signals toward two probes 220, each of which connect to the BLE chipsets 208 via resistors 218 and a common feed line.

Preferably, Bluetooth Low Energy (BLE) is the wireless technology used for communications between the user devices 103 and the nodes 160.162.

Typically, the directional antenna 152 establishes the close proximity of a user 104 to an access point such as a door, and the omnidirectional BLE antenna 150 allows the system 100 to continuously monitor (e.g. track) the locations of the users 104. In one implementation, the directional antenna can receive BLE broadcasts from user devices 103 located typically within a 3 foot by 3 foot region or threshold area in front of an access point. The access point, in turn, enables access to a restricted area of a building 102. In contrast, the omnidirectional antenna 150 can receive BLE broadcasts sent from user devices 103 in all locations/directions. Typically, the omnidirectional antenna 150 can receive BLE broadcasts sent from user devices 103 located beyond the threshold area but that are also still within the signal range of the omnidirectional antenna 150.

Using positioning techniques (e.g., time of flight to each antenna, triangulation with other positioning units, and/or signal strength calculations), the door node 160 is able to determine the location of the user devices 103. Additionally, the use of an omnidirectional antenna 150 and a directional antenna 152 enable finer granularity in the location calculations since the directional antenna 111-*b* can be used to generate finer location information within a specific region such as a door threshold.

In the illustrated example, the door node 160 also includes a network interface controller 202, a WiFi antenna. 212, a node controller 204, an antenna controller 206 and BLE chipsets 208, and a camera 210. The controller 204 drives the function of the door node 160, including sending and receiving user information, authentication information, and device information to other nodes 160, 162 via the network interface controller 202. The BLE controller 206 directs the function of the BLE chipsets 208, which in turn interpret the radio frequency signals received from the antennas 150, 152. The network interface controller 202 provides an interface with the network 113. This enables the door node 160 to communicate with the verification and tracking system 115 and the door controllers 112. The network interface controller 202 also connects to a WiFi antenna 212, which provides an alternative means of connecting to the network 113 and allows the door node 160 to communicate with other nodes 160, 162. The camera 210 captures video information at the access point such as users 104 approaching the threshold. The video information can be sent to the verification and tracking system 115, where it can be analyzed to determine if there are unauthorized users near the access point, among other examples.

Figure 3:
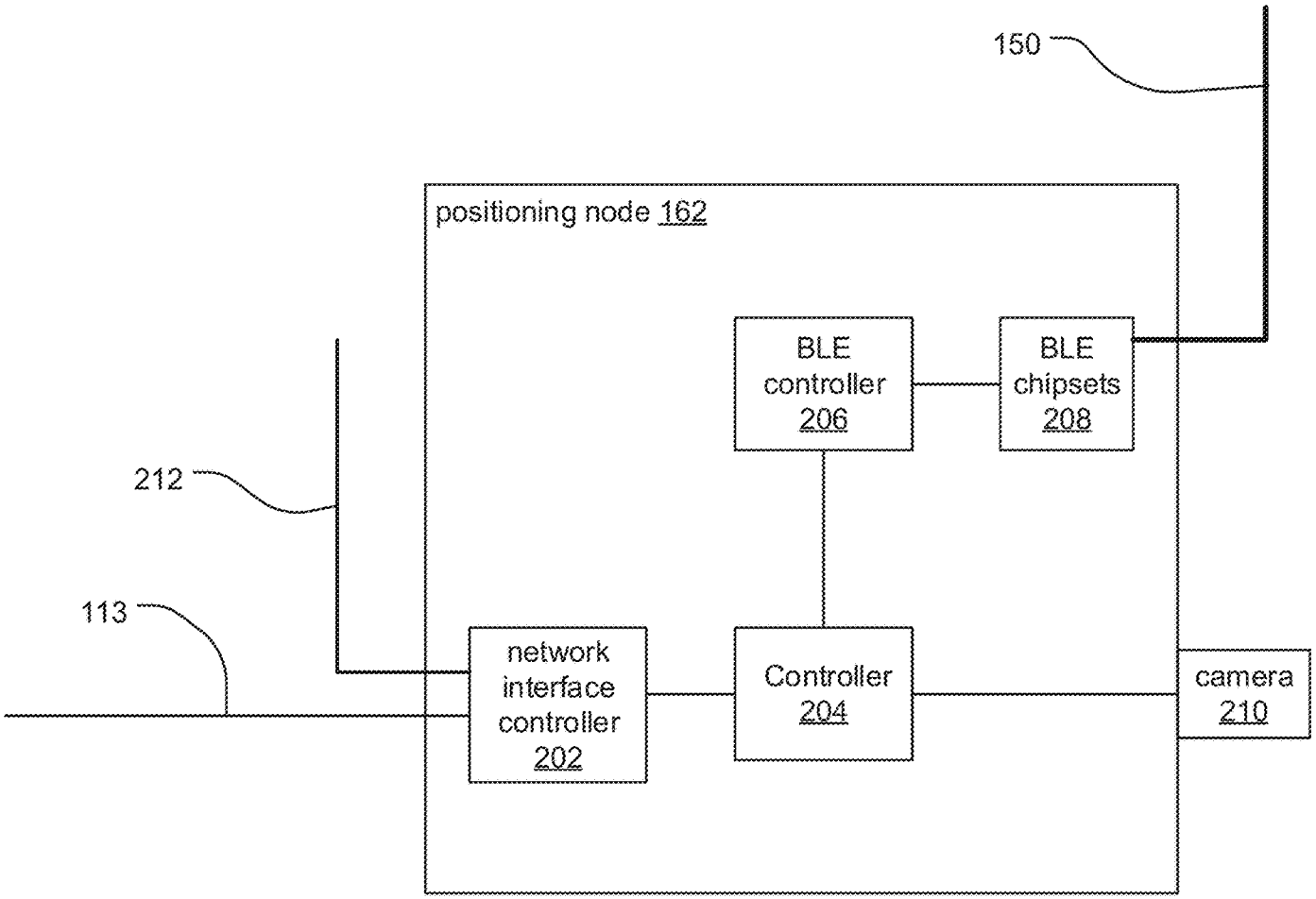
FIG. 3 is a schematic diagram illustrating one embodiment of the positioning node.

FIG. 3 is a schematic diagram illustrating a preferred embodiment of the positioning node 162, which is nearly identical to the door node 160. However, because the positioning nodes 162 are designed to extend coverage of user tracking to areas outside the range of door nodes 160 installed at access points, positioning nodes 162 typically only include an omni directional antenna 150 and do not include a directional antenna 152. The camera 210 is typically a wide angle camera to video information in the room.

Figure 4:
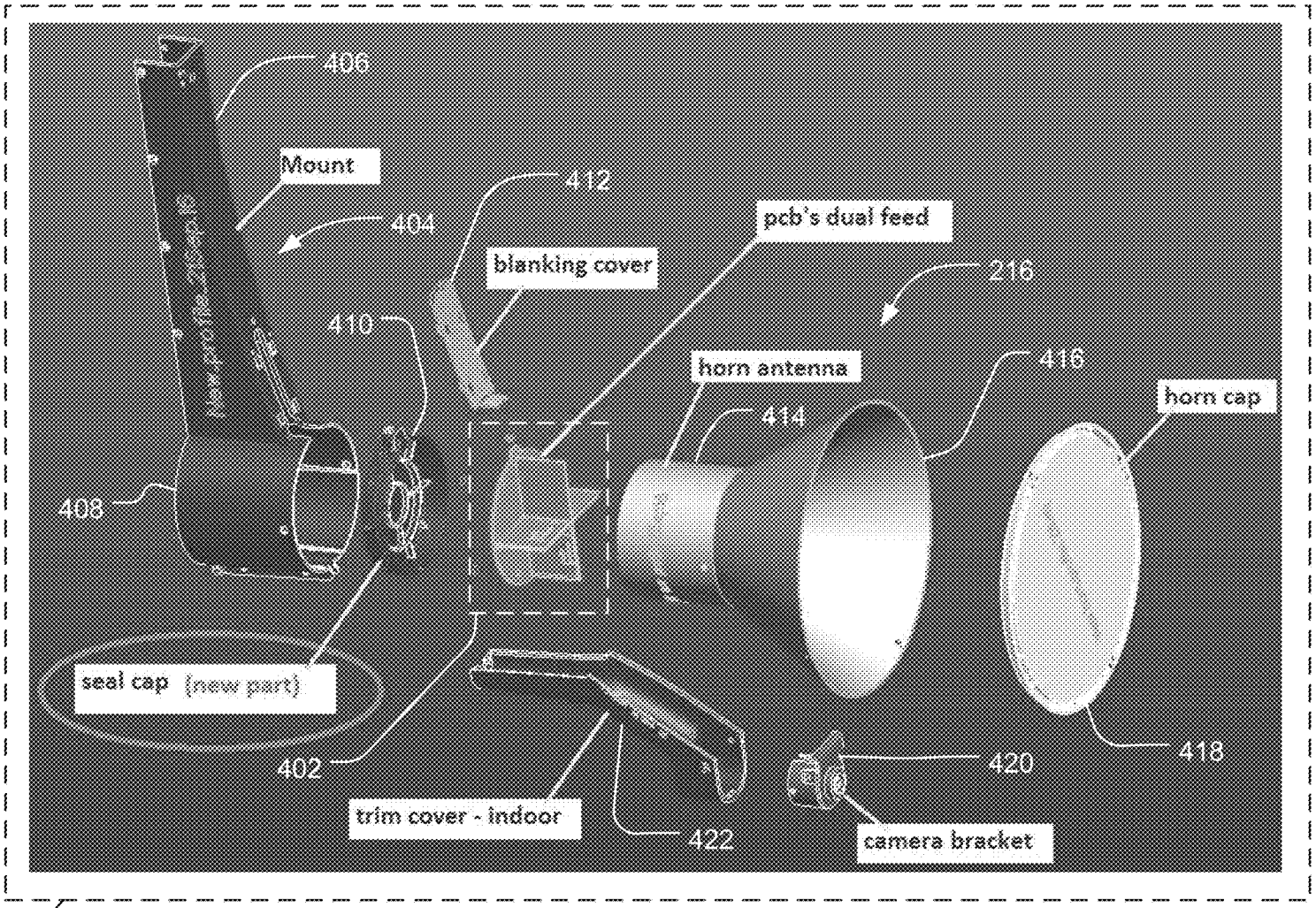
FIG. 4 is an exploded view of the preferred embodiment of the directional antenna assembly of the directional antenna of the door node.

FIG. 4 is an exploded view of the preferred embodiment of the directional antenna assembly 214 of the directional antenna 152 of the door node 160. The directional antenna assembly 214 includes a mount 404, a rotation stage 409, a seal cap 410, a blanking cover 412, an antenna probe assembly 402, an antenna horn 216, a horn cap 418, or radome, a camera bracket 420, and a trim cover 422.

The mount 404 comprises a hollow cylindrical base 408 and an arm 406. The arm 406 extends radially from the base 408. The bottom end of the arm 406 is integral with the base 408 along a portion of the circumference of the base 408 and along almost the entire axial length of the base 408, and the width of the arm 406 gradually decreases along the length of the arm 406, from the bottom end to the top. A recessed region extends axially from the front face of the cylindrical base 408 to the arm 406 and continues along about a fifth of the length of the arm 406.

The seal cap 410 is a hollow cylindrical cap with one solid circular face and one open face. The exterior surface along the seal cap's 410 short axial length forms a lip for partially surrounding the antenna probe assembly 214, over which the seal cap is fitted. A notch extends radially from the top of the lip along the entire axial length of the seal cap 410. The notch has a width that corresponds to the width of the recessed region of the base 408 of the mount 404 such that the notch of the seal cap 410 passes through the recessed region of the base 408 of the mount 404.

The antenna horn 216 includes a cylindrical base 414, into which the antenna probe assembly 402, including the two probes 220, is inserted, and a frusto conical horn 416, over which the horn cap 418 is positioned.

Figure 5A:
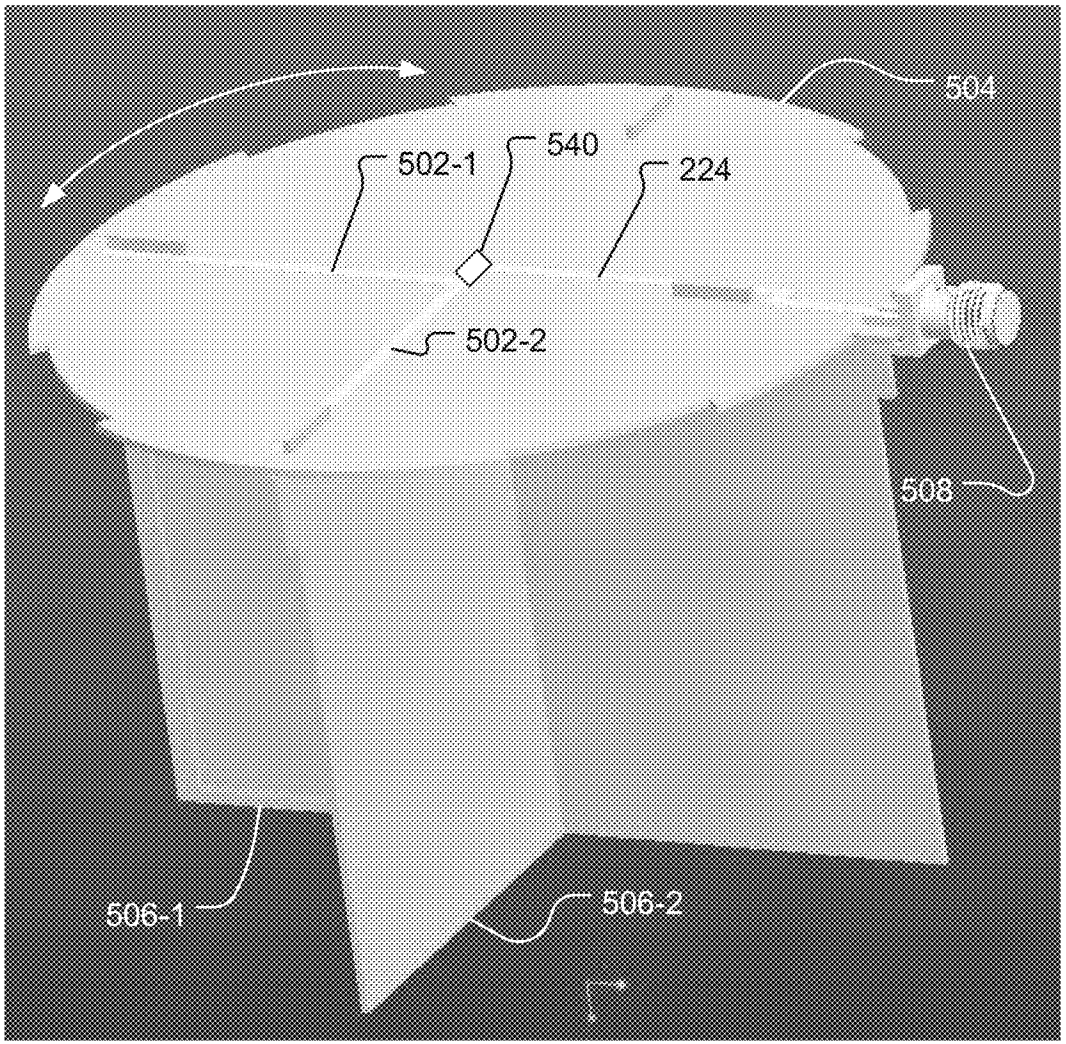
FIG. 5A is scale perspective view of the directional antenna probe assembly of the directional antenna of the door node.

FIG. 5A is a diagram of the antenna probe assembly 402 of the directional antenna 152. Included are a circular probe base 504, first and second probe boards 506 a first antenna feed line 502-1 and a second antenna feed line 502-2.

The probe base 504 and probe boards 506 are printed circuit boards (PCB). The probe base 504 provides a mounting point for the two probe boards 506, each of which attach perpendicularly to the probe base 504 and to each other. The probe base also 504 functions as the end plate of the waveguide, and houses the components for combining the radiofrequency signals from each probe 220 and routing them to a single SMA connector 508. Each of the feedlines 502 terminates in a common feed line 224.

The probe boards 506 contain the probes 220, which are preferably microstrip probes. Additional probes 220 can also be added to the probe boards 506.

Figure 5B:
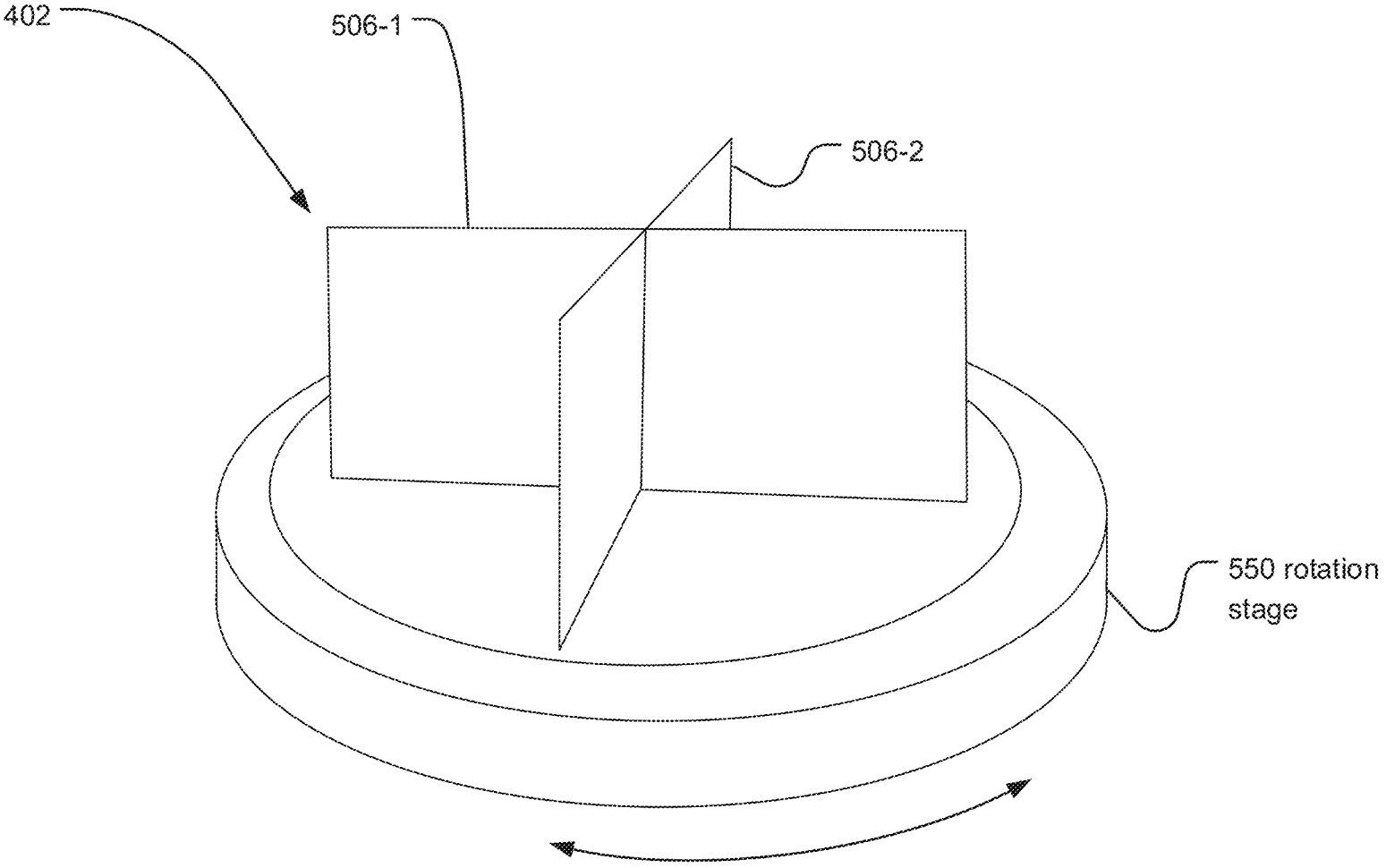
FIG. 5B is a perspective view of the directional antenna probe assembly, including a rotation stage for aligning the probes.

FIG. 5B is a diagram of the directional antenna probe assembly 402 of the directional antenna 152, including a rotation stage 550 for aligning the probes 220. The directional antenna probe assembly 402 attaches to the rotation stage 550 such that the position of directional antenna probe assembly 402 is stage with respect to the rotation stage 550. The rotation stage 550 is then rotated as indicated. In this way, the probe assembly 214 can be rotationally aligned within the horn 216 to adjust the placement of the probes and optimize the gain of the antenna so that it best matches and overlaps with the threshold area.

Figure 6:
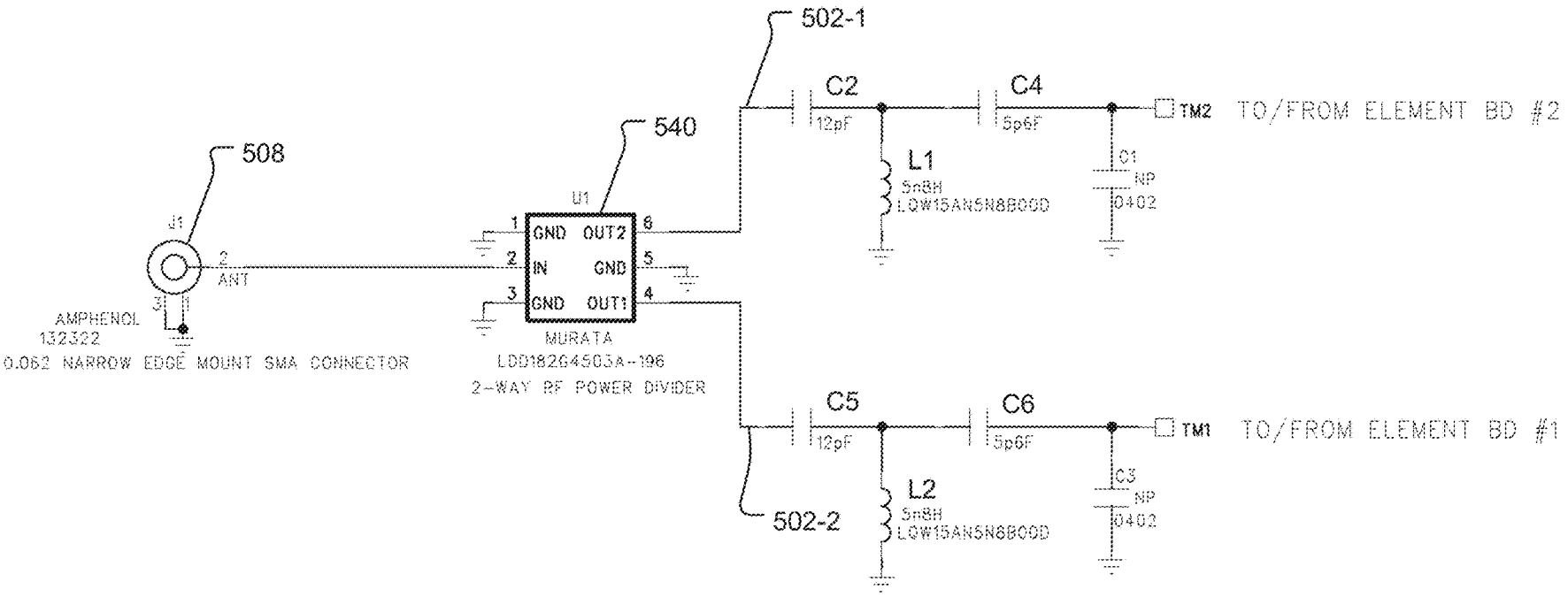
FIG. 6 is a circuit diagram for the probe.

FIG. 6 is a circuit diagram of a combining circuit for the two probes 220.

Each of the first antenna feed line 502-1 and a second antenna feed line 502-2 contains respective LC circuits. The first antenna feed line 502-1 has capacitors C1, C2, C4, and inductor L1. The second antenna feed line 502-2 has capacitors C5, C6, C3 and inductor L2. They terminate in a RF power divider 540. The RF power divider couples to the connector 508.

FIGS. 7A-7I are floor plan diagrams of a room illustrating how the access control system 100 tracks users 104 moving throughout the room.

Figure 7A:
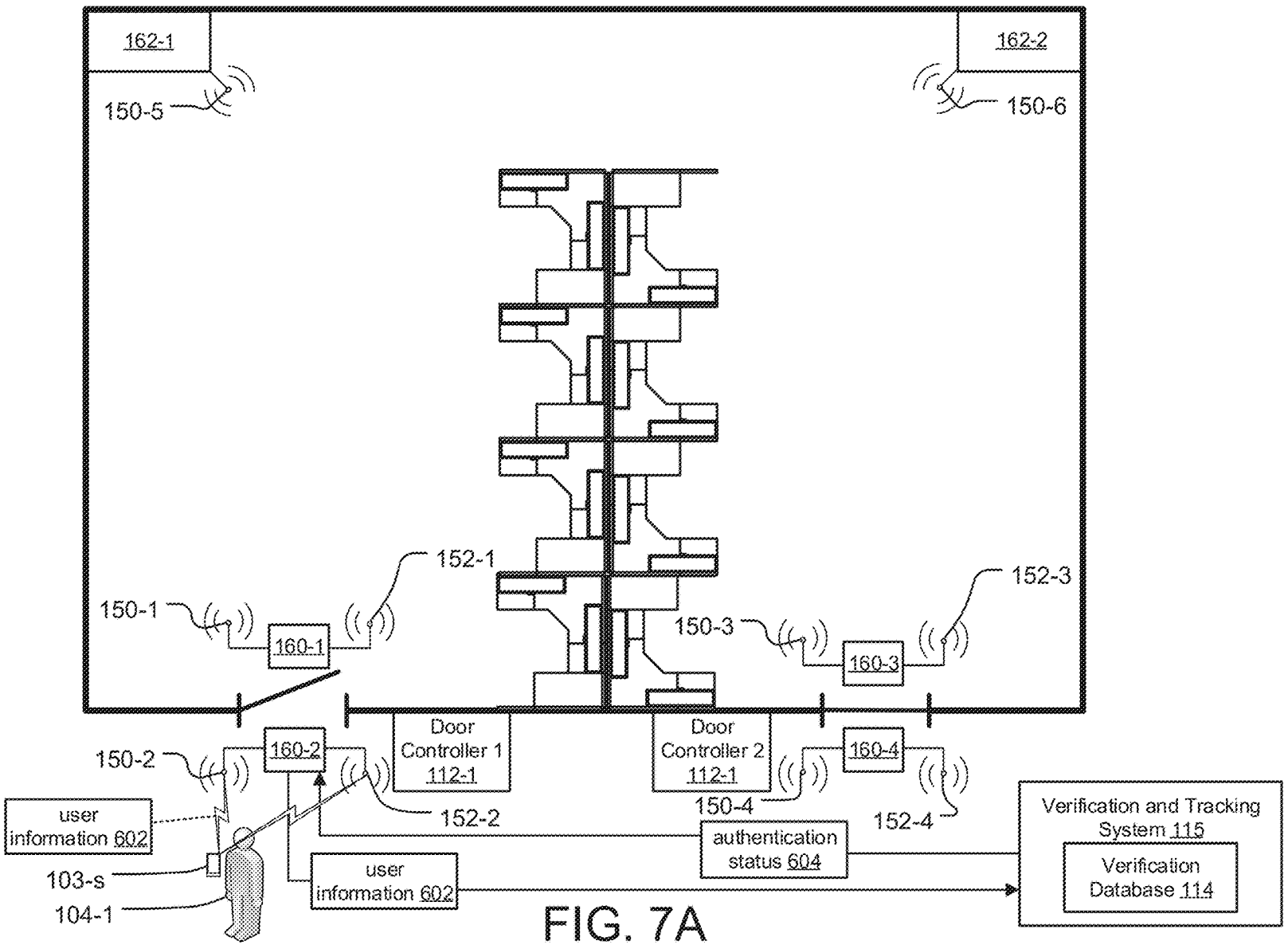
FIG. 7A is a floor plan diagram of a room illustrating how the access control system tracks users moving throughout the room, wherein a user approaches the first door of the room from the outside.

In FIG. 7A, the user 104-1 approaches the first door of the room. The user's 104-1 smart phone 103-*s* sends user information 602 (such as a token) to the door node 160-2 installed outside the first door. The door node 160-2 determines that the user 104-1 is in proximity of the door and sends the user information 602 to the verification and tracking system 115. The verification and tracking system 115 sends the authentication status 604 of the user 104-1 back to the door node 160-2, and access is granted, or not, to the user 104-1 based on their access rights.

Figure 7B:
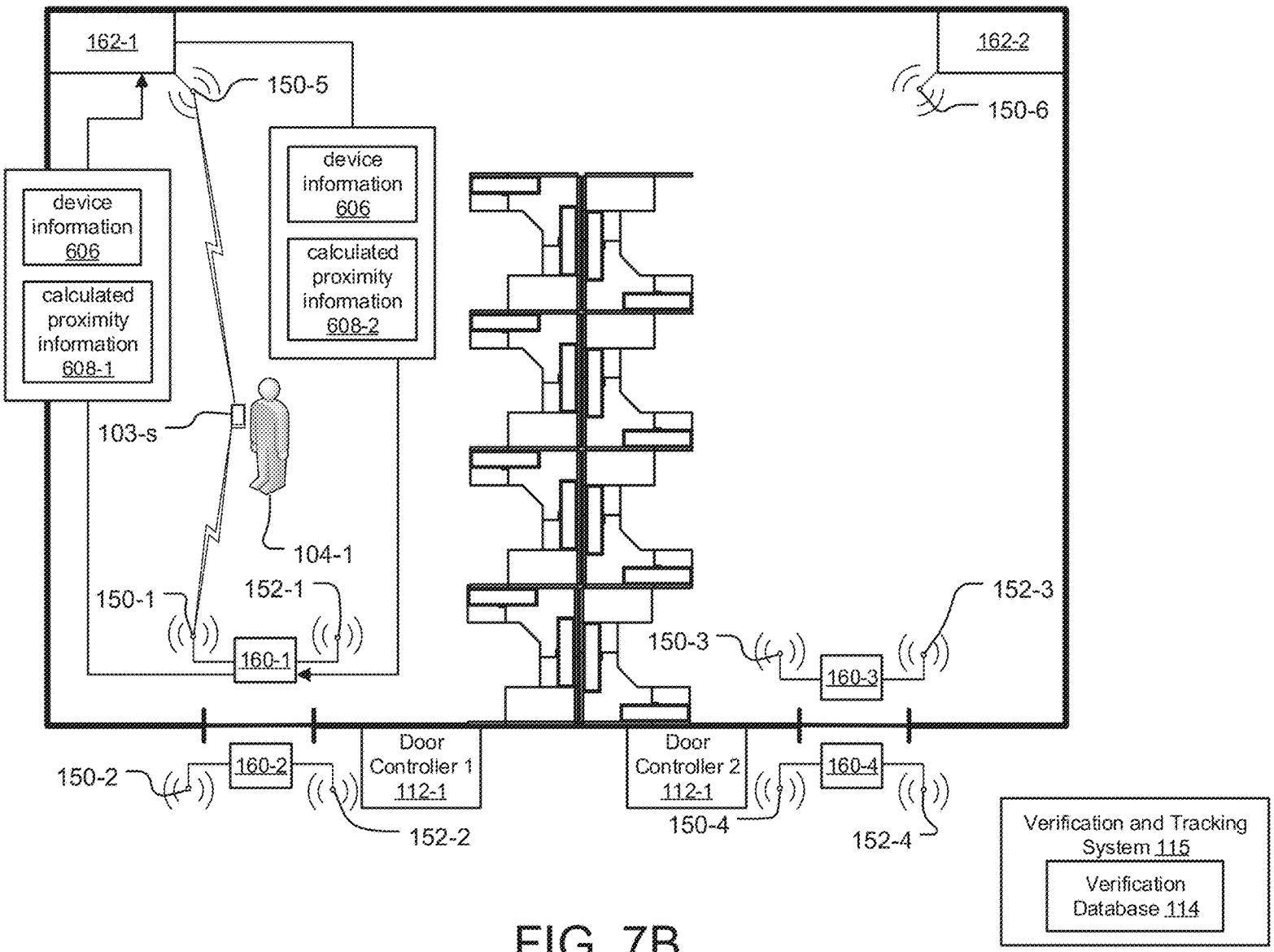
FIG. 7B is a floor plan diagram of a room illustrating how the access control system tracks users moving throughout the room, wherein the user has entered the room.

In FIG. 7B, the user 104-1 has entered the room and is detected by the door node 160-1 and the positioning node 162-1. The door node 160-1 calculates the approximate distance between the user 104-1 and the door node 160-1 (for example, using RSSI). The positioning node 162-1 then sends the calculated proximity information 608-1 and device information 606 associated with the user device 103-*s* to the positioning node 162-1. Device information 606 can include a unique network identification for the device such as a media access control (MAC) address, among other examples. Similarly, the positioning node 162-1 calculates the approximate distance between the user 104-1 and the positioning node 162-1 then sends the calculated proximity information 608-2 and device information 606 to the door node 160-1. Each node 160-1, 162-1 determines that the user is still closest to the door node 160-1.

Figure 7C:
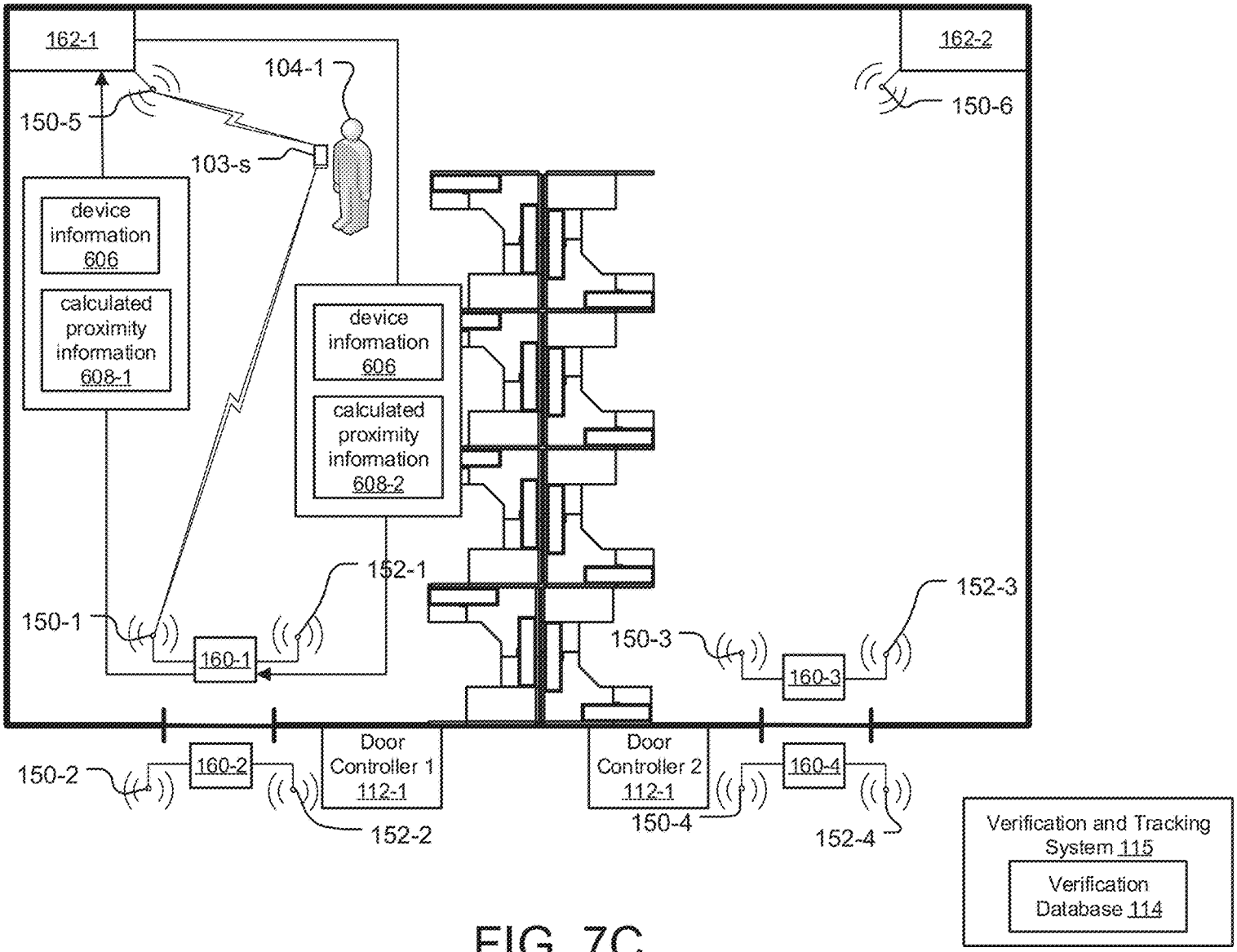
FIG. 7C is a floor plan diagram of a room illustrating how the access control system tracks users moving throughout the room, wherein the user approaches the first positioning node.
Figure 7D:
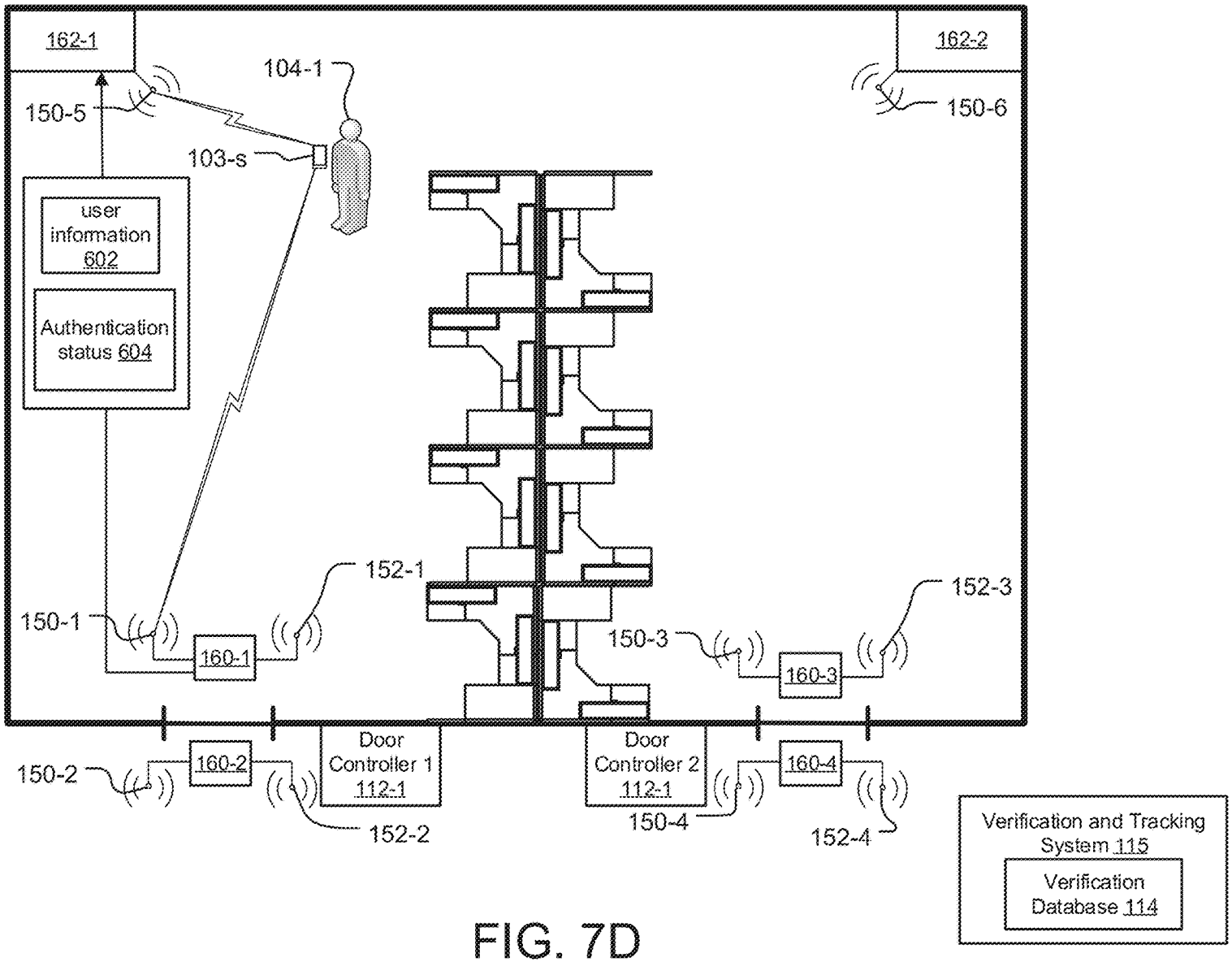
FIG. 7D is a floor plan diagram of a room illustrating how the access control system tracks users moving throughout the room, wherein the door node sends user and authentication information to the first positioning node.

In FIG. 7C, the user 104-1 has changed position. As before, the two nodes exchange calculated proximity information 608 and determine that the user 104-1 has moved closer to the positioning node 162-1. Therefore, in FIG. 7D, the user information 602 and authentication status 604 are sent from the door node 160-1 to the positioning node 162-1.

Figure 7E:
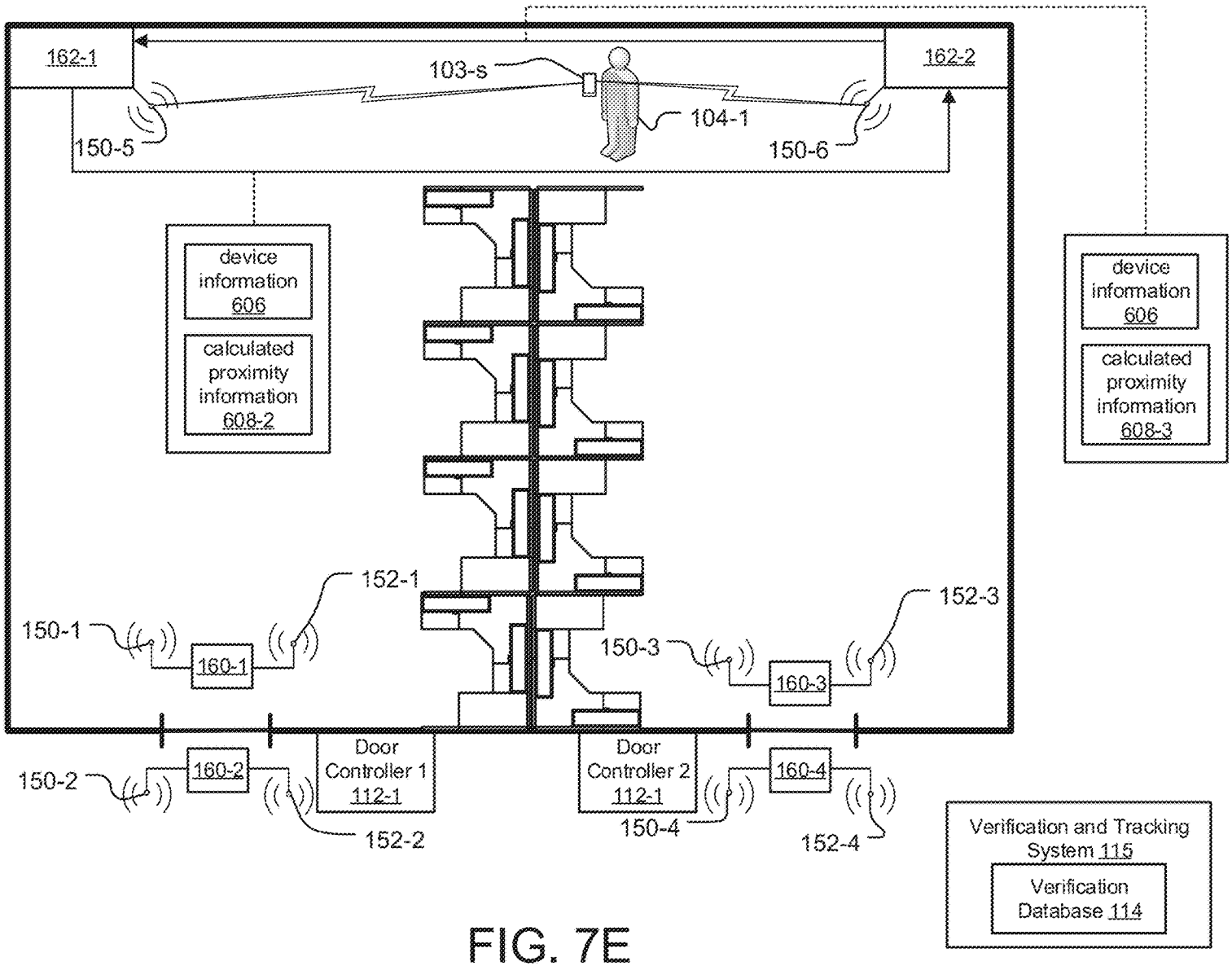
FIG. 7E is a floor plan diagram of a room illustrating how the access control system tracks users moving throughout the room, wherein the user approaches the second positioning node.
Figure 7F:
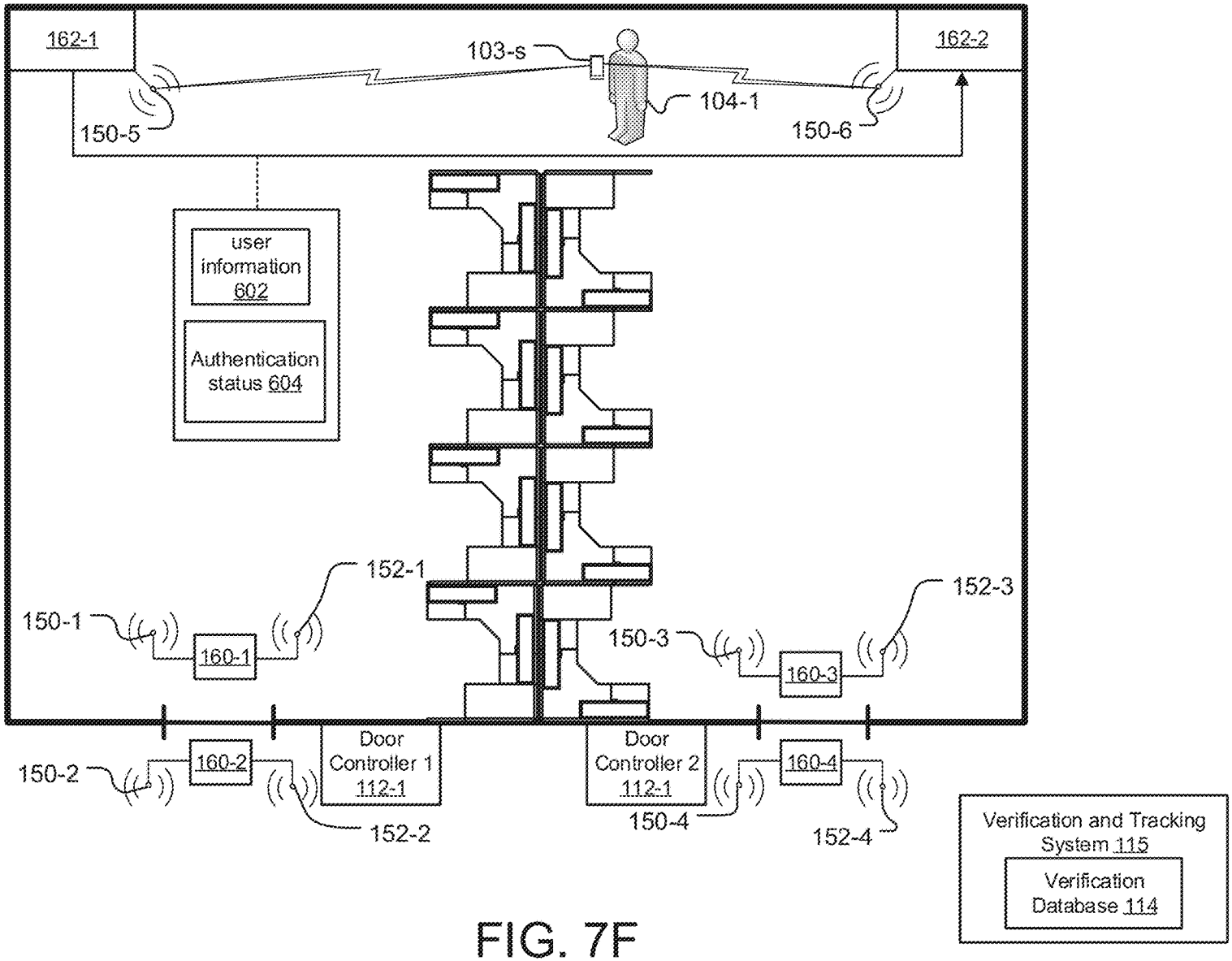
FIG. 7F is a floor plan diagram of a room illustrating how the access control system tracks users moving throughout the room, wherein the first positioning node sends user and authentication information to the second positioning node.

Similarly, in FIG. 7E, the user 104-1 has moved again. Now the user 104-1 stands between the first positioning node 162-1 and the second positioning node 162-2. As before, the two nodes determine that the user is closest to the second positioning node 162-2 by exchanging calculated proximity information 608. In FIG. 7F, the user information 602 and authentication status 604 is then passed from the first positioning node 162-1 to the second positioning node 162-2.

Figure 7G:
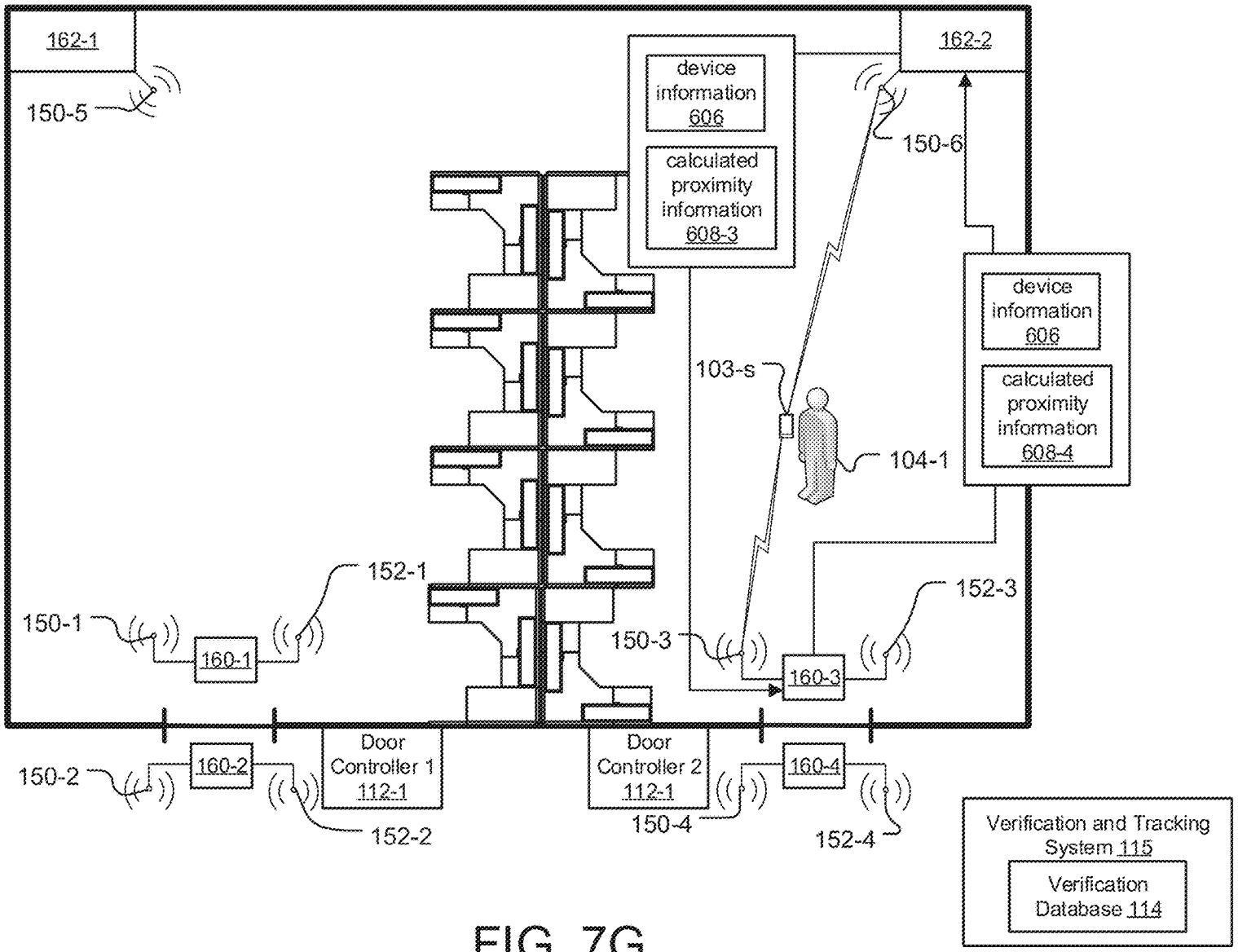
FIG. 7G is a floor plan diagram of a room illustrating how the access control system tracks users moving throughout the room, wherein the user approaches the second door.
Figure 7H:
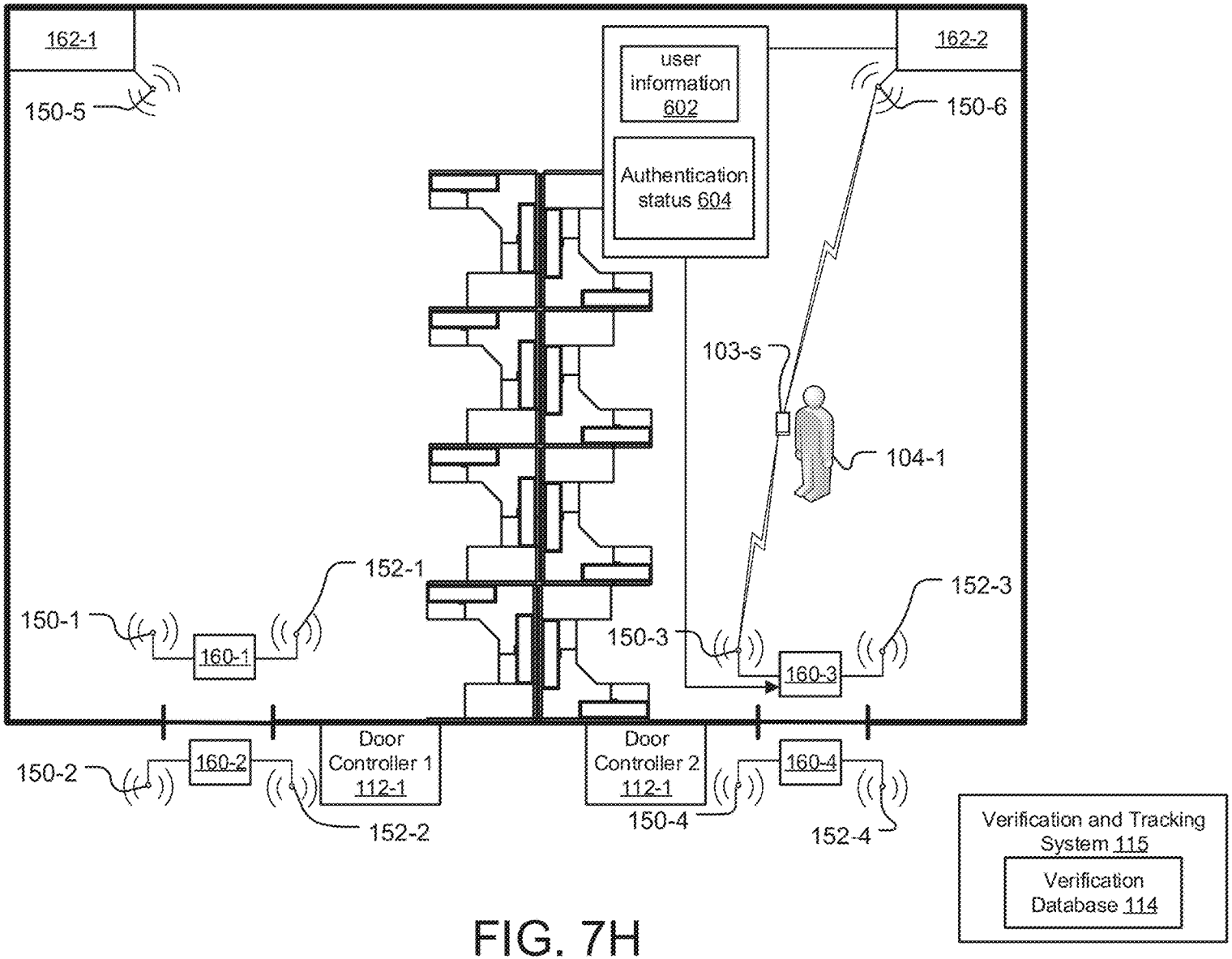
FIG. 7H is a floor plan diagram of a room illustrating how the access control system tracks users moving throughout the room, wherein the second positioning node sends user and authentication information to the second door node.

In FIG. 7G, the user 104-1 has moved to a location between the second positioning node 162-2 and the third door node 160-3. As before, the two nodes determine that the user has moved closest to the door node 160-3. In FIG. 7H, the user information 602 and authentication status 604 is then passed from the positioning node 162-2 to the door node 160-3.

Figure 7I:
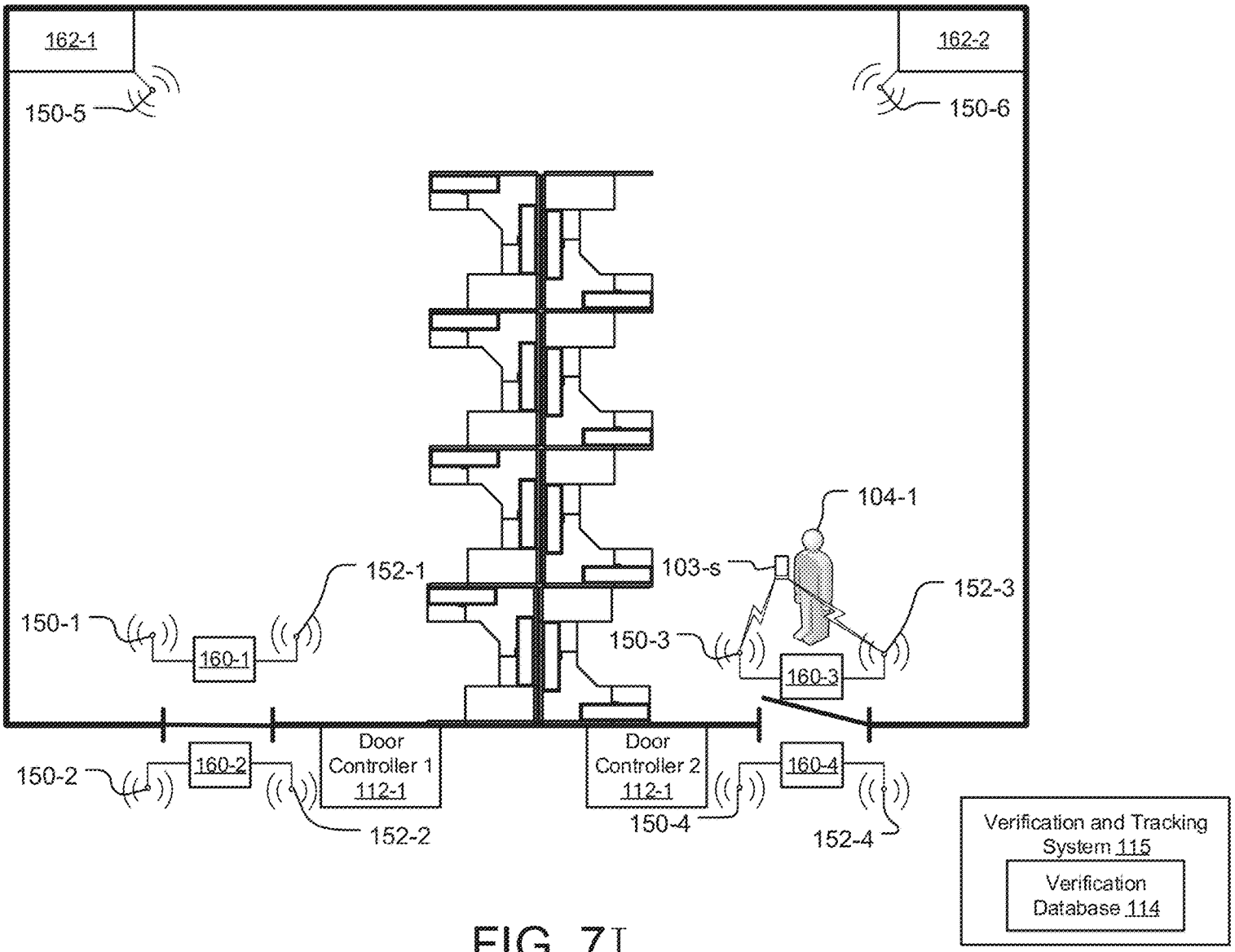
FIG. 7I is a floor plan diagram of a room illustrating how the access control system tracks users moving throughout the room, wherein access is granted to the second door.

In FIG. 7I, the door node 160-3 determines that the user 104-1 is in proximity to the door. The door node 160-3 confirms the authentication status 604 of the user 104-1 (for example, by making sure it is not expired) and access is granted to the user 104-1. If the authentication status 604 was expired, the door node 160-3 would determine if access should be granted as previously described, by sending the user information 602 to the verification and tracking system 115.

While this invention has been particularly shown and described with references to preferred embodiments thereof, it will be understood by those skilled in the art that various changes in form and details may be made therein without departing from the scope of the invention encompassed by the appended claims.

What is claimed is:

1. An access control and user tracking system for a security system, the access control and user tracking system comprising:

a verification and tracking system for receiving user information and generating authentication status information; and nodes, each comprising wireless interfaces, for receiving user information and device information from user devices via the wireless interfaces and sending and receiving the device information and the authentication status information to and from other nodes and the verification and tracking system, wherein the nodes exchange proximity information concerning how close the user devices are to each of the nodes and the nodes send the device information and the authentication status information to the nodes that are closest to the user device, wherein each of a plurality of nodes detects a particular user device based on wireless signals from the user device;

each node that detected the user device generates proximity information for the detected user device by calculating an approximate distance between the detected user device and the node that detected the user device based on the wireless signals;

each node that detected the user device sends the generated proximity information to other nodes and receives proximity information generated by the other nodes;

each node that detected the user device determines which node is closest to the user device based on the generated and received proximity information; and a first node that detected the user device sends the authentication status information to a second node that detected the user device in response to determining that the user device has moved from being closest to the first node to being closest to the second node based on the proximity information.

2. The system as claimed in claim 1, wherein the wireless interfaces include directional antennas.

3. The system as claimed in claim 2, wherein the directional antennas include adjustable assemblies, each comprising two or more elements for detecting electromagnetic waves.

4. The system as claimed in claim 1, wherein the wireless interfaces include omnidirectional antennas.

5. The system as claimed in claim 1, wherein the wireless interfaces include Bluetooth transceivers.

6. The system as claimed in claim 1, wherein the wireless interfaces include WiFi transceivers.

7. The system as claimed in claim 1, wherein the nodes calculate a proximity of the user devices to the nodes and send the calculated proximity information to other nodes.

8. The system as claimed in claim 7, wherein the nodes compare the calculated proximity information to calculated proximity information received from other nodes.

9. The system as claimed in claim 1, further comprising door controllers for receiving authentication status information from the nodes and granting or denying access based on the authentication status information.

10. The system as claimed in claim 1, wherein the user devices include smart phones and/or fobs.

11. A method for providing access control and tracking users of a security system, the method comprising:

nodes with wireless interfaces receiving user information and device information from user devices and sending the user information to a verification and tracking system;

the verification and tracking system receiving the user information, generating authentication status information, and sending the authentication status information to the nodes; and the nodes sending the user information, device information and authentication status information to other nodes in response to movement of the user devices by exchanging proximity information concerning how close the user devices are to each of the nodes and the nodes sending the device information and the authentication status information to the nodes that are closest to the user device, wherein each node that detected a user device generates proximity information for the detected user device by calculating an approximate distance between the detected user device and the node that detected the user device based on the wireless signals; and a first node that detected the user device sends the authentication status information to a second node that detected the user device in response to determining that the user device has moved from being closest to the first node to being closest to the second node based on the proximity information.

12. The method as claimed in claim 11, wherein the wireless interfaces include directional antennas.

13. The method as claimed in claim 12, wherein the directional antennas include adjustable assemblies, each comprising two or more elements for detecting wireless signals waves.

14. The method as claimed in claim 11, wherein the wireless interfaces include omnidirectional antennas.

15. The method as claimed in claim 11, wherein the wireless interfaces include Bluetooth transceivers.

16. The method as claimed in claim 11, wherein the wireless interfaces include WiFi transceivers.

17. The method as claimed in claim 11, further comprising the nodes calculating a proximity of the user devices to the nodes and sending the calculated proximity information to other nodes.

18. The method as claimed in claim 17, further comprising nodes comparing the calculated proximity information to calculated proximity information received from other nodes.

19. The method as claimed in claim 11, further comprising door controllers receiving authentication status information from the nodes and granting or denying access based on the authentication status information.

20. The method as claimed in claim 11, wherein the user devices include smart phones and/or fobs.

21. The access control and user tracking system as claimed in claim 1, wherein the plurality of nodes include a door controller, which grants access to a user of the user device based on the authentication status information.

* * * * *